US008479397B2

(12) United States Patent
Sato et al.

(10) Patent No.: US 8,479,397 B2
(45) Date of Patent: Jul. 9, 2013

(54) ELECTRIC SHAVER

(75) Inventors: Masaaki Sato, Hikone (JP); Hiroaki Shimizu, Hikone (JP); Shin Hosokawa, Hikone (JP); Takeshi Shiba, Hikone (JP)

(73) Assignee: Panasonic Corporation, Osaka (JP)

( * ) Notice: Subject to any disclaimer, the term of this patent is extended or adjusted under 35 U.S.C. 154(b) by 746 days.

(21) Appl. No.: 12/687,435

(22) Filed: Jan. 14, 2010

(65) Prior Publication Data

US 2010/0180448 A1 Jul. 22, 2010

(30) Foreign Application Priority Data

Jan. 16, 2009 (JP) ..... 2009-007422

(51) Int. Cl.
*B26B 19/04* (2006.01)

(52) U.S. Cl.
USPC ..... 30/43.92; 30/346.51

(58) Field of Classification Search
USPC ..... 30/43.7–43.92, 346.51
See application file for complete search history.

(56) References Cited

U.S. PATENT DOCUMENTS

| | | | | |
|---|---|---|---|---|
| 5,539,984 | A | 7/1996 | Ikuta et al. | |
| 5,551,154 | A * | 9/1996 | Tanahashi et al. | 30/43.92 |
| 6,568,083 | B1 * | 5/2003 | Iwasaki et al. | 30/43.2 |
| 7,017,270 | B2 * | 3/2006 | Shiba et al. | 30/43.92 |
| 7,334,338 | B2 * | 2/2008 | Shiba et al. | 30/43.92 |
| 7,739,798 | B2 * | 6/2010 | Iwasaki et al. | 30/43.92 |
| 8,296,955 | B2 * | 10/2012 | Sato et al. | 30/43.92 |
| 2004/0237310 | A1 * | 12/2004 | Shiba et al. | 30/43.92 |
| 2005/0016002 | A1 | 1/2005 | Fukutani et al. | |
| 2005/0138821 | A1 * | 6/2005 | Tsushio et al. | 30/527 |
| 2005/0274019 | A1 * | 12/2005 | Inoue et al. | 30/43.7 |
| 2006/0021227 | A1 * | 2/2006 | Shiba et al. | 30/43.92 |
| 2006/0137187 | A1 * | 6/2006 | Fukutani et al. | 30/43.92 |
| 2007/0056166 | A1 * | 3/2007 | Shiba et al. | 30/44 |
| 2007/0227007 | A1 * | 10/2007 | Fukutani et al. | 30/43.1 |
| 2007/0245565 | A1 * | 10/2007 | Sato et al. | 30/43.92 |
| 2008/0256799 | A1 | 10/2008 | Shiba | |
| 2009/0241343 | A1 | 10/2009 | Yamasaki et al. | |
| 2010/0018057 | A1 | 1/2010 | Fukutani et al. | |
| 2010/0180446 | A1 * | 7/2010 | Shimizu et al. | 30/43.92 |
| 2010/0180447 | A1 | 7/2010 | Sato et al. | |
| 2010/0180448 | A1 * | 7/2010 | Sato et al. | 30/43.92 |

FOREIGN PATENT DOCUMENTS

| | | |
|---|---|---|
| EP | 0662375 | 7/1995 |
| EP | 1439040 | 7/2004 |
| EP | 1676680 | 7/2006 |
| EP | 1886776 | 2/2008 |
| JP | 9-19575 | 1/1997 |

(Continued)

*Primary Examiner* — Katherine Mitchell
*Assistant Examiner* — Jaime F Cardenas-Garcia
(74) *Attorney, Agent, or Firm* — Greenblum & Bernstein, P.L.C.

(57) ABSTRACT

In an electric shaver moving inner blades reciprocally and linearly, outer blades which are elongated in longitudinal direction are respectively held on outer blade frames and the outer blade frames are further held in floatable in floating direction on a frame holder. An outer blade mounting base has a pair of protrusions formed at positions near to both ends thereof in the longitudinal direction to protrude in the floating direction and the frame holder has a pair of end walls arranged in parallel in the longitudinal direction and a pair of engaging rims formed at both ends in the longitudinal direction. The engaging rims enclose the protrusions so as to position the frame holder to the outer blade mounting base when the frame holder is attached to the outer blade mounting base.

15 Claims, 9 Drawing Sheets

FOREIGN PATENT DOCUMENTS

| | | |
|---|---|---|
| JP | 2001-334078 | 12/2001 |
| JP | 2001-347082 | 12/2001 |
| JP | 2002-282561 | 10/2002 |
| JP | 2005-040358 | 2/2005 |
| JP | 2005-192615 | 7/2005 |
| WO | 2009/008244 | 1/2009 |

* cited by examiner

ELECTRIC SHAVER

BACKGROUND OF THE INVENTION

1. Field of the Invention

The present invention relates to a reciprocation type electric shaver in which inner blades move reciprocally and linearly.

2. Description of the Related Art

Conventionally, a reciprocation type electric shaver, which is disposed in Publication Gazette of Unexamined Japanese Patent Application 9-19575, for example, comprises a plurality of sets of an inner blade and an outer blade, in which the outer blades are disposed at a head portion of a main body of the electric shaver, and the inner blades are driven reciprocally to slide inside of the outer blades by a reciprocation motor. The outer blades and the inner blades are held on the main body in floatable so that cutting face of the inner blade and the outer blade can follow human skin to be treated.

The outer blade is fixed on an outer blade frame and the outer blade frame is further held on a frame holder in floatable. A protrusion is formed on each side face of the outer blade frame in a lengthwise direction of the outer blade (corresponding to the reciprocal moving direction of the inner blade), and a guide groove, with which the protrusion engages, is formed on each inner face of the frame holder in the lengthwise direction of the outer blade. Since the outer blade frame is held at only both side faces, when a large external force is applied to the outer blade, the outer blade is not held stable and it may wobble.

SUMMARY OF THE INVENTION

The present invention is conceived to solve the above mentioned problems and purposed to provide an electric shaver which enables to prevent wobble of outer blades in use and to shave beards effectively with good usability by stably holding the outer blades by a simple and compact configuration.

An electric shave in accordance with an aspect of the present invention comprises:

a plurality of outer blades which is formed of a metal thin plate and has an elongated shape in a first direction and is arranged in a second direction perpendicular to the first direction;

a plurality of outer blade frames which has an elongated shape in the first direction and to which the outer blades are respectively attached;

a plurality of inner blades which is reciprocally and linearly moved in the first direction to slide on inner faces of the outer blades, and arranged in the second direction;

a driving unit which has a plurality of inner blade attaching bases protruding outward in a third direction perpendicular to both of the first direction and the second direction and drives the inner blades reciprocally and linearly in the first direction;

an outer blade mounting base which is provided on a top portion of the driving unit and has a pair of protrusions formed at positions near to both ends thereof in the first direction to protrude in the third direction; and a frame holder which is attached to the outer blade mounting base and has a pair of end walls arranged in parallel in the first direction and a pair of engaging rims formed at both ends in the first direction, wherein each of the end wall has a plurality of guide grooves elongated in the third direction to which the outer blade frames are engaged so as to hold the outer blade frames in floatable in the third direction, and the engaging rims enclose the protrusions so as to position the frame holder to the outer blade mounting base when the frame holder is attached to the outer blade mounting base.

According to such a configuration, when the frame holder is attached to the outer blade mounting base, the engaging rims of the frame holder enclose the protrusions of the outer blade mounting base, so that positioning of the frame holder to the outer blade mounting base can be performed precisely. In addition, since the end walls of the frame holder and the protrusions of the outer blade mounting base adjoin each other in the state that the frame holder is mounted on the outer blade mounting base, the protrusions serves as reinforcing members of the end walls in the first direction. Therefore, even when a large external force acts on the outer blades, quantities of warps of the end walls of the frame holder supporting the outer blade frames become smaller, and thus, wobbling of the outer blades in use can be made smaller.

BRIEF DESCRIPTION OF THE DRAWINGS

The present invention will be described hereinafter with reference to the annexed drawings. It is to be noted that all the drawings are shown for the purpose of illustrating the technical concept of the present invention or embodiments thereof, wherein.

DETAILED DESCRIPTION OF THE EMBODIMENT

An electric shaver in accordance with an embodiment of the present invention is described with reference to the figures. In the following description, directions such as front, rear, left, right, up and down are referred in arrows illustrated in the figures, but the electric shaver can be used with no relation to posture of the electric shaver in real space. In addition, an electric shaver having four sets of inner blades and outer blades is exemplified. Four outer blades are two meshed blade disposed at both ends in the anteroposterior direction Y, a finishing meshed blade and a slit blade disposed therebetween, for example.

Figure 1:
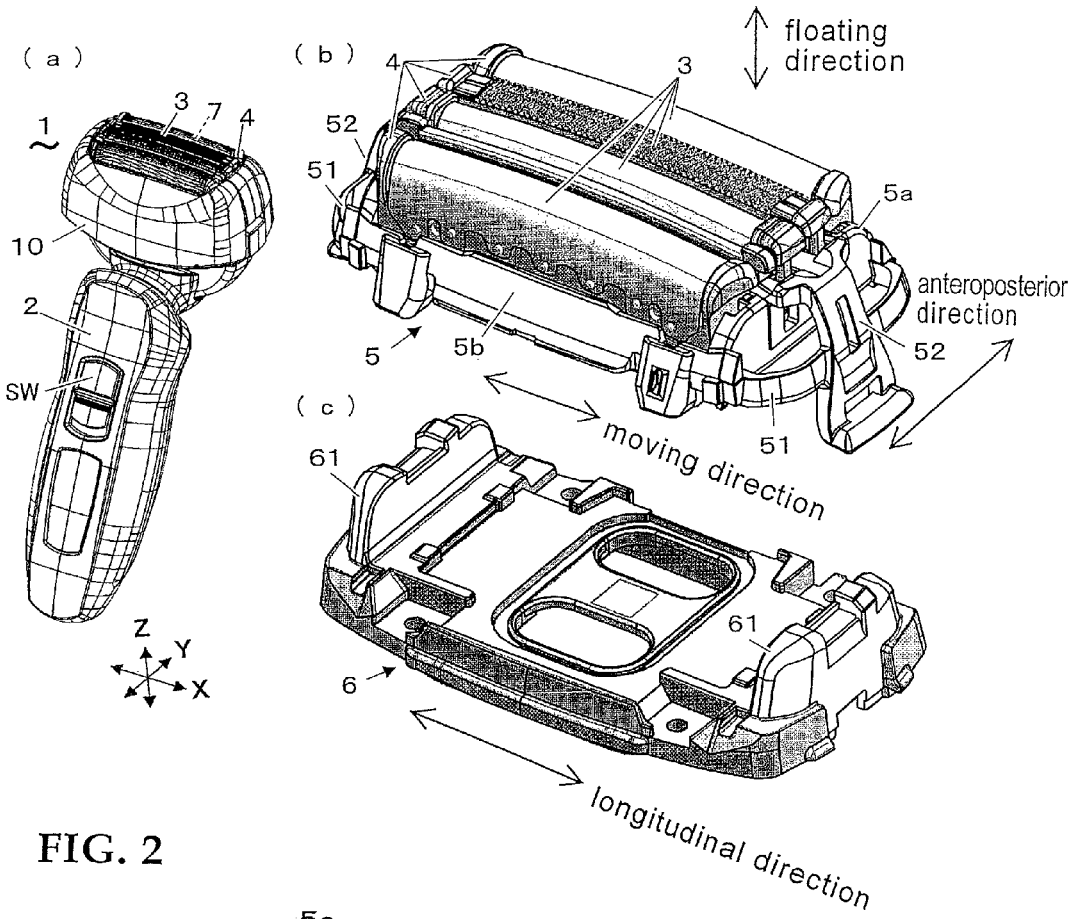
FIG. 1A is a perspective view showing an appearance of an electric shaver in accordance with an embodiment of the present invention.
FIG. 1B is a perspective view showing an assembly of outer blades, outer blade frames and a frame holder of the electric shaver.
FIG. 1C is a perspective view showing a configuration of an outer blade mounting base of the electric shaver.

As shown in FIG. 1A, the electric shaver 1 comprises a main body 2 serving as a handle and a head portion 10 provided at upside of the main body 2. The head portion 10 further comprises a plurality of sets of an outer blade 3 and an inner blade 7 (see FIG. 8) which slides inside of the outer blade 3. The main body 2 further comprises a secondary battery to be charged and a control circuit (not shown in the figure) and a main switch SW provided on a front face thereof. The main body 2 has a shape suitable to be handled by a user. A driving motor 70 for driving the inner blades 7 to move reciprocally and linearly in a predetermined moving direction is provided in the head portion 10 (see FIG. 10). Each outer blade 3 is formed of a metal thin plate to have an array of slits arranged in the moving direction of the inner blade or meshes, for example. The outer blades 3 are respectively fixed on outer blade frames 4.

As shown in FIGS. 1B and 1C, the head portion 10 has an outer blade holing structure configured of the outer blade frames 4 to which the outer blades 3 are fixed, a frame folder 5 which holds the outer blade frames 4 movably in floating direction (third direction) Z perpendicular to both of the moving direction X of the inner blades 7 and the arrangement direction Y of the outer blades 3, and an outer blade mounting base 6 to which the frame holder 5 is attached. Hereinafter, the moving direction X of the inner blades 7 is called "longitudinal direction (first direction) X" and the arrangement direction Y of the outer blades 3 is called "anteroposterior direction (second direction) Y". The outer blade mounting base 6 has a pair of protrusions 61 protruding upward from the top face thereof and formed at positions near to both ends in the longitudinal direction X. The frame holder 5 has a pair of engaging rims 51 formed at both ends in the longitudinal direction X so as to engage with the protrusions 61 when the frame holder 5 is attached to the outer blade mounting base 6. When the frame holder 5 is attached to the outer blade mounting base 6, the engaging rims 51 enclose the protrusions 61 so that the frame holder 5 is positioned on the outer blade mounting base 6. The electric shaver 1 in this embodiment has four sets of the outer blades 3 and four inner blades 7 and four outer blade frames 4, correspondingly.

Figure 2:
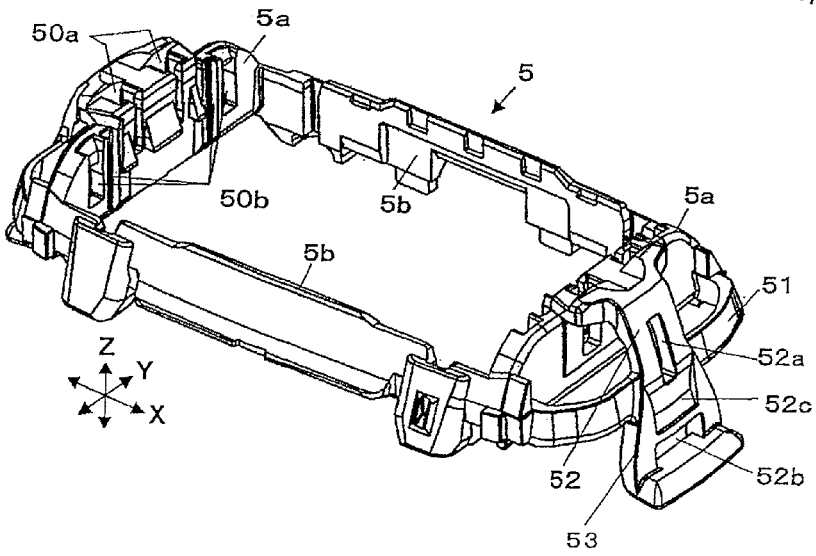
FIG. 2 is a perspective view showing a configuration of the outer blade holder.

As shown in FIG. 2, the frame holder 5 has two end walls 5*a* at both ends in the longitudinal direction X and two side walls 5*b* parallel to the longitudinal direction X to form a substantially rectangular opening. A pair of engaging rims 51 is formed to have an arc shape protruding outward to bind an end of a rear side wall 5*b* to an end of a front side wall 5*b* at both ends of the frame holder 5 in the longitudinal direction X. In addition, a pair of engaging arms 52 is formed to protrude outward in the longitudinal direction X and downward in the floating direction Z from center portions of top faces of the end walls 5*a*. Each engaging arm 52 crosses the engaging rim 51 at a middle portion thereof and integrally formed with the engaging rim 51. In addition, a lower end 53 of the engaging arm 52 is disposed below the bottom of the engaging rim 51, and protruded outward in the longitudinal direction X.

Each end wall 5*a*, which binds the rear side wall 5*b* and the front side wall 5*b*, is formed parallel to the anteroposterior direction Y and has a height substantially equal to that of the protrusion 61 in the floating direction Z when the frame holder 5 is attached to the outer blade mounting base 6. In addition, two pairs of fitting grooves 50*a* and 50*b* elongating in the floating direction are formed on each end wall 5*a*. The fitting grooves 50*a* and 50*b* serve as guide grooves which enable the outer blade frames 4 to move in the floating direction Z, and fit to fitting pieces 41 formed on both end portions of the outer blade frames 4 in the longitudinal direction X. The fitting grooves 50*a*, which are located inward of the end wall 5*a* in the anteroposterior direction Y, are formed further to penetrate the top face of the engaging arm 52 in the floating direction Z.

Rigidity of the engaging arm 52 is set to be larger than that of the engaging rim 51. A rigidity adjusting groove 52*a*, however, is formed on the engaging arm 52 so as not to be the rigidity of the engaging arm 52 too large. The lower end 53 of the engaging arm 52 in the floating direction Z serves as an engaging portion (hereinafter, it is called "engaging portion 53") and an opening 52*b* which opens in the longitudinal direction is formed. In addition, a recess 52*c* is formed on an outer surface of the engaging arm 52 at a position above the opening 52*b* and below the rigidity adjusting groove 52*a* in the floating direction Z.

Figure 3:
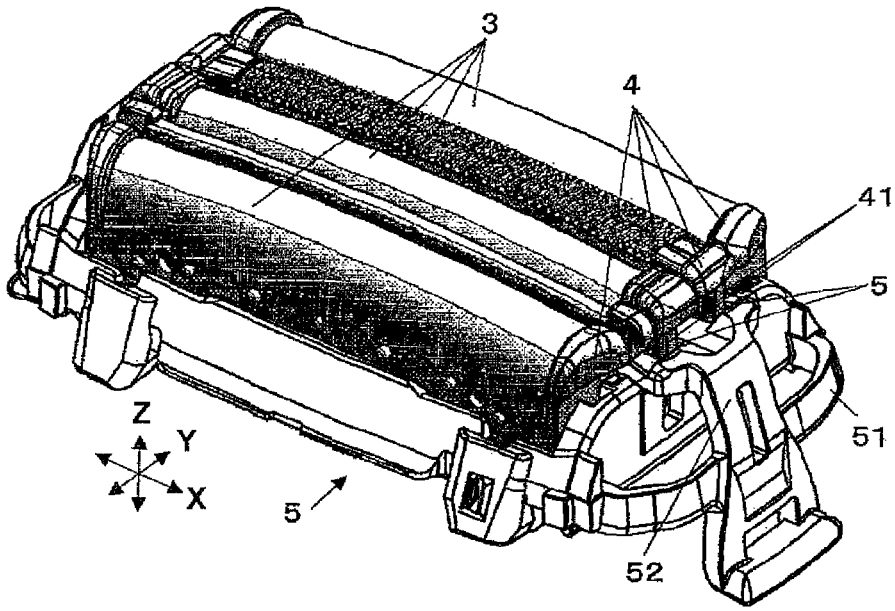
FIG. 3 is a perspective view showing an assembly of the outer blades, the outer blade frames and the frame holder of the electric shaver further including detailed numerical references.

As shown in FIG. 3, four outer blade frames 4, to which the outer blades 3 are fixed, are arranged in the anteroposterior direction on the above mentioned frame holder 5, and the outer blades 3 and the outer blade frames 4 are held to be integrally floatable in the floating direction Z by fitting the above mentioned fitting pieces 41 to the fitting grooves 50*a* and 50*b*. Each outer blade frame 4 is a frame member having a rectangular opening oblong in the longitudinal direction X and opened in the floating direction Z. The outer blade frames 4 are attached to the frame holder 5 from below in the floating direction Z, and prevented to penetrate through the fitting grooves 50*a* and 50*b* by stoppers not shown.

Figure 4:
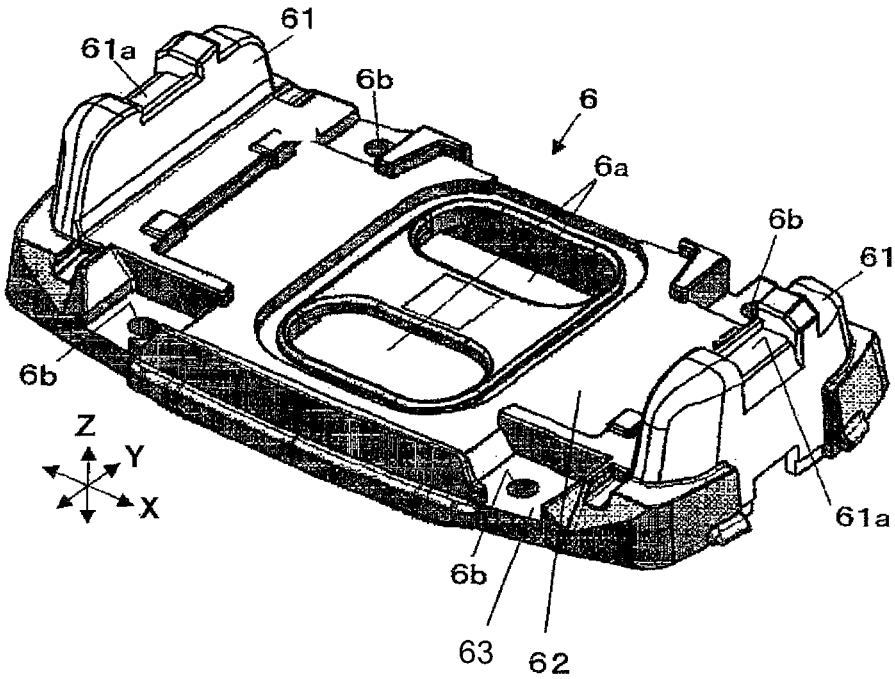
FIG. 4 is a perspective view showing the configuration of the outer blade mounting base further including detailed numerical references.
Figure 5:
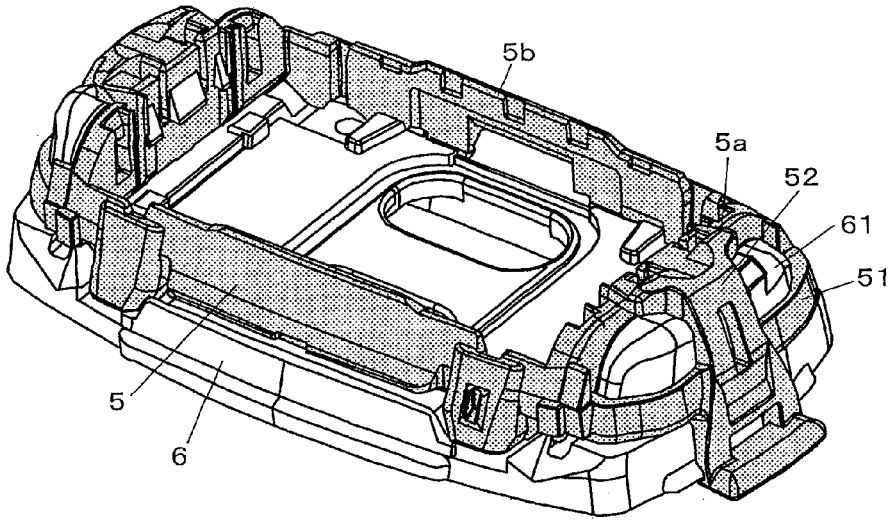
FIG. 5 is a perspective view showing an attachment of the outer blade holder with the outer blade mounting base.

As shown in FIG. 4, the outer blade mounting base 6 has a base portion 62 having a substantially rectangular and flat plate shape which corresponds to the substantially rectangular opening of the frame holder 5. The above mentioned protrusions 61 are formed at both outer side of the base portion 62 in the longitudinal direction X to protrude upward in the floating direction Z and to elongate in the anteroposterior direction Y. A concave portion 61*a* which has a shape fitted to the engaging arm 52 is formed at an upper center of the protrusion 61. FIG. 5 shows a state that only the frame holder 5 is attached to the outer blade mounting base 6 which is not actual use but for purpose of illustration. A sectional shape of the protrusion 61 is substantially the same as that of a space formed by the end wall 5*a* and the engaging rim 51 of the frame holder 5 in a plane parallel to a surface of the base portion 62. Thus, when the frame holder 5 is attached to the outer blade mounting base 6, the engaging rims 51 and the engaging arms 52 of the frame holder 5 tightly enclose the protrusions 61 of the outer frame base 6, so that the frame holder 5 is positioned to the outer frame base 6. In addition, two openings 6*a* which are oblong in the longitudinal direction X are arranged in the anteroposterior direction Y at the center of the base portion 62 of the outer blade mounting base 6. Moreover, recesses 63 and screw holes 6*b* are formed at portions near to four corners of the base portion 62 in the longitudinal direction X and in the anteroposterior direction Y.

Figure 6:
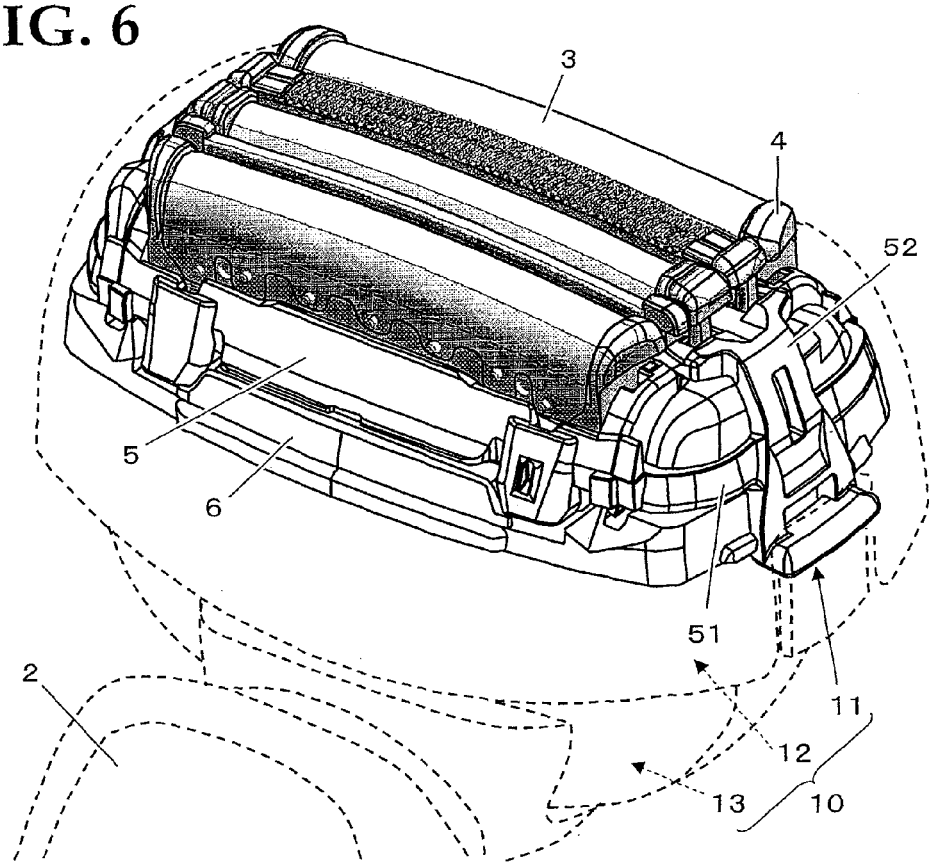
FIG. 6 is a perspective view showing the assembly of the outer blades, the outer blade holder and the outer blade mounting base in a head portion of the electric shaver.

FIG. 6 shows a state that the outer blade frames 4 with the outer blades 3 are attached to the frame holder 5 and the frame holder 5 is further mounted on the outer blade mounting base 6. The head portion 10, which is illustrated by dotted lines, is configured by a head cover 11, a driving unit 12 and a swing mechanism 13. The head cover 11 covers the frame holder 5 and lower portions of the outer blade frames 4. The driving unit 12 is disposed below the outer blade mounting base 6 including a driving mechanism for driving the inner blades 7. In addition, the outer blade mounting base 6 serves as an upper cover of the driving unit 12. The swing mechanism 13 includes a swing mechanism enabling to swing the head cover 11 and the driving unit 12 in the longitudinal direction X and in the anteroposterior direction Y with respect to the main body 2.

Figure 7:
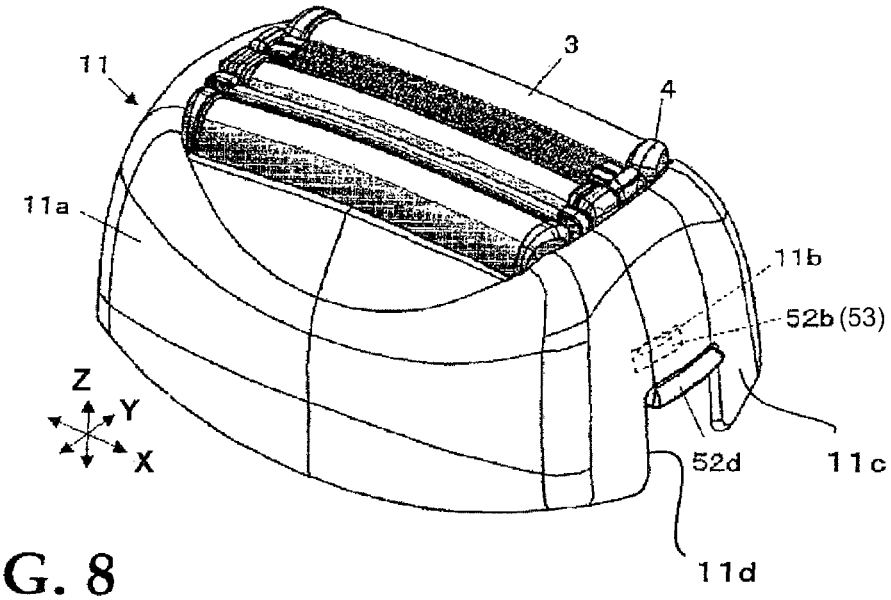
FIG. 7 is a perspective view showing an outer blade unit detached from the head portion of the electric shaver.

As shown in FIG. 7, the frame base 5 with the outer blades 3 and the outer blade frames 4 is further attached to the head cover 11. Cuttings 11*d* are formed at lower ends in the floating direction Z on end walls 11*c* of an outer frame 11*a* of the head cover 11 in the longitudinal direction X, and the lower ends of the engaging arms 52 of the frame holder 5 with the cuttings 11*d*, so that first push buttons 52*d* are protruded outward in the longitudinal direction X. First hooks (protrusions) 11*b* which are to be engaged with the engaging portions 53(openings 52*b*) of the engaging arm 52 are formed on an inner face of the end walls 11*c* of the head cover 11 just above the cuttings 11*d*. When the frame holder 5 is inserted into the head cover 11 from a bottom opening in the floating direction Z in a state that the lower ends of the engaging arms 52 of the frame holder 5 are engaged with the cuttings 11*d* of the head cover 11, the first hooks 11*b* move smoothly along the recesses 52*c* of the engaging arms 52 (see FIG. 2). When the engaging arms 52 contact with the first hooks 11*b*, the engaging arms 52 are elastically deformed so that the first hooks 11*b* are engaged with the engaging portions 52*b* of the engaging arms 52. Thus, the frame holder 5 is fitted to the head cover 11. In order to disconnect the frame holder 5 from the head cover 11, the first push buttons 52*d* are pushed inward in the longitudinal direction X. Thereby, the engaging arms 52 are elastically deformed, so that fitting of the first hooks 11*d* with the engaging portions 53 is released. Under such a state, when the frame holder 5 is pulled down in the floating direction Z with respect to the head cover 11, the frame holder 5 is disconnected from the head cover 11.

Figure 8:
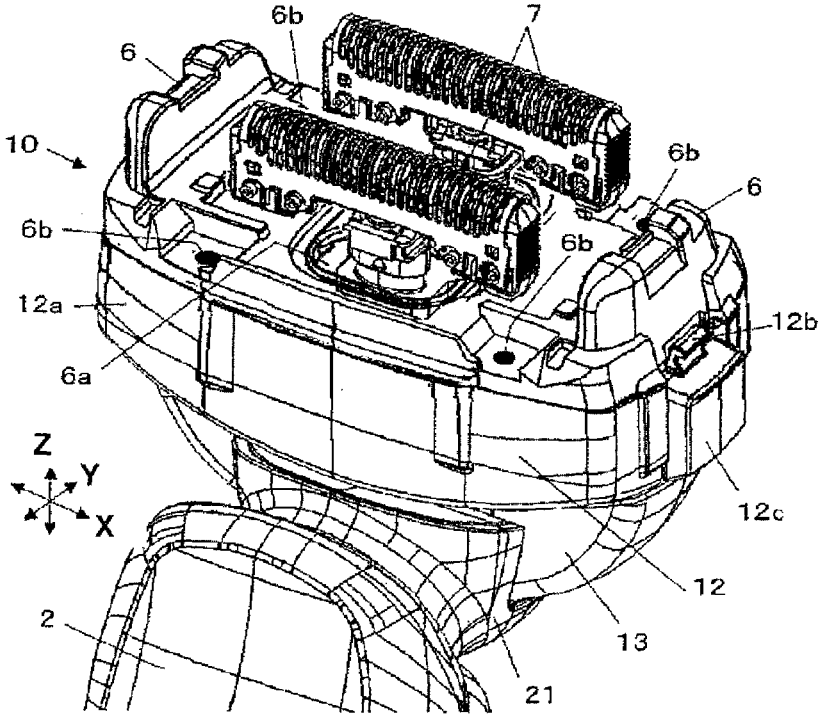
FIG. 8 is a perspective view showing a configuration in a vicinity of the head portion of the electric shaver from which the outer blade unit is removed.
Figure 9:
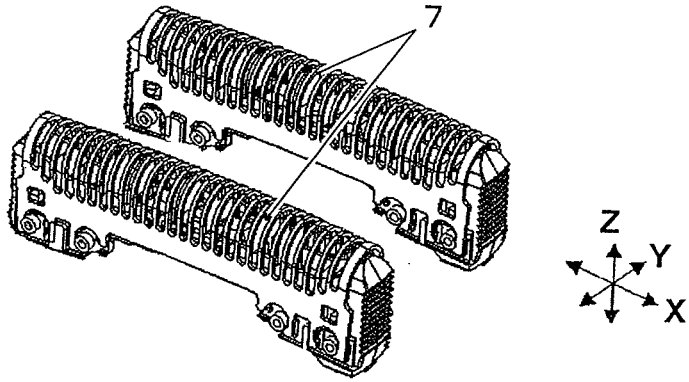
FIG. 9 is a perspective view showing configurations of inner blades of the electric shaver.
Figure 10:
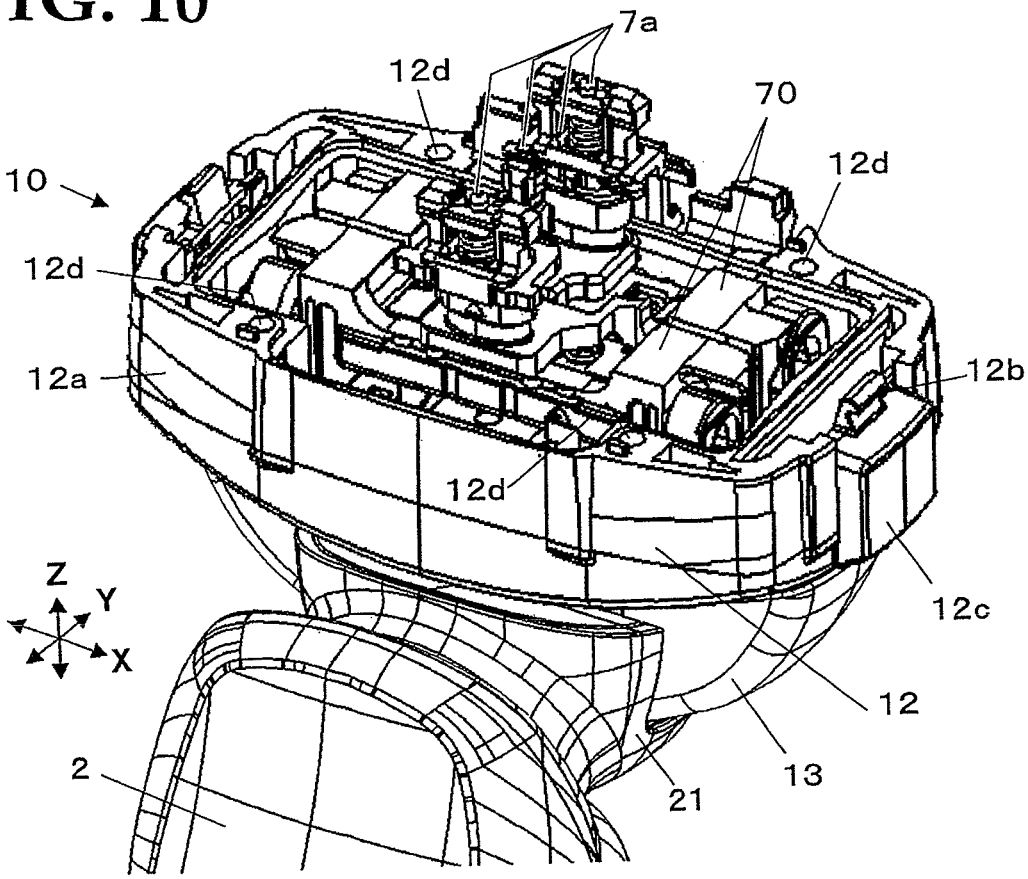
FIG. 10 is a perspective view showing a configuration in the vicinity of the head portion of the electric shaver from which the inner blades and the outer blade mounting base are further removed.

As shown in FIGS. 8, 9 and 10, a pair of second hooks 12*b* which is protruded outward in the longitudinal direction X and downward in the floating direction Z is provided at center in the anteroposterior direction Y of a housing 12*a* of the driving unit 12 and in upper portion at both ends in the longitudinal direction X. In addition, a pair of second push buttons 12*c* for moving the second hooks 12*b* inward in the longitudinal direction X is provided below the second hook 12*b*. In case to mount the head cover 11 shown in FIG. 7 to the driving unit 12 shown n FIG. 8, the head cover 11 is overlain on the driving unit from above in the floating direction Z, and the head cover 11 is further pushed down. Thereby, the engaging arms 52 of the frame holder 5 contact the second hooks 12*b* so that the second hooks 12*b* move inward in the longitudinal direction X, and thus, the engaging portions 53 (openings 52*b*) are engaged with the second hooks 12*b*. Consequently, the head cover 11 is fixed on the driving unit 12. For disengaging the head cover 11 from the driving unit 12, the second push buttons 12*c* are moved inward in the longitudinal direction X. Thereby, the engagement of the engaging portions 53 (openings 52*b*) with the second hooks 12*b* is released. Under such a state, by pulling up the head cover 11 upward in the floating direction Z, the head cover 11 can be disengaged from the driving unit 12. In other words, it is possible not only to position the frame holder 5 to the outer blade mounting base but also to fix the frame holder 5 on the driving unit 12 of the head portion 10.

The outer blade mounting base 6 is fixed on the top of the driving unit 12 be engaging screws penetrating through the screw holes 6*b* with pilot holes 12*d* formed on the housing 12*a* of the driving unit 12. The driving unit 12 has two linear motors 70, and each linear motor 70 has two inner blade attaching bases 7*a*. Each two inner blade attaching bases 7*a* are projected parallel to the floating direction from two openings 6*a* of the outer blade mounting base 6. Two inner blades 7, which correspond to two outer baled frames 4 disposed outside among four outer blade frames 4 arranged in the anteroposterior direction Y, are attached to inner blade attaching bases 7*a* disposed outward among four inner blade attaching bases 7*a* arranged in the anteroposterior direction Y. Inner blades corresponding to two inner blades are attached to the outer blade frames 4 so as to be moved reciprocally in the longitudinal direction X. When the head cover 11 is attached to the driving unit 12, two inner blade attaching bases 7*a* disposed inward are respectively engaged with the inner blades attached to the outer blade frames 4. Two linear motors 70 are respectively driven by opposite phases, so that four inner blades are reciprocally moved in the longitudinal direction X. In addition, the inner blade attaching bases 7*a* are respectively floatable in the floating direction Z.

As mentioned above, according to the electric shaver 1 in this embodiment, since the engaging rims 51 of the frame holder 5 enclose the protrusions 61 formed at positions near to both ends of the outer blade mounting base 6 in the longitudinal direction X in a plane defined by the longitudinal direction X and the anteroposterior direction Y, the frame holder 5 is positioned and fixed on the outer blade mounting base 6 in the longitudinal direction X and in the anteroposterior direction Y. In addition, since the engaging arms 52 of the frame holder 5 enclose the protrusions 61 of the outer blade mounting base 6 in a plane defined by the longitudinal direction X and the floating direction Z, the frame holder 5 is positioned and fixed on the outer blade mounting base 6 in the longitudinal direction X and the floating direction Z. Consequently, the fixing strength and positioning accuracy of the frame holder 5 to the outer blade holder 6 can be increased. Even when large forces are applied to the outer blades 3, the outer blade frames 4 with the outer blades 3 are stably held on the frame holder 5 so that the outer blades 4 may not be wobbled in use and effective shaving can be performed with good usability. Moreover, since the engaging rims 51 and the engaging arms 52 reinforce the strength of the frame holder 5, rigidity of the frame holder 5 can be increased. Furthermore, since the engaging arms 52 having larger rigidity can absorb an external force such as dropping impact, the engaging rims 51 having smaller rigidity can be protected from the external force, and thus, breakage of the frame holder 5 can be prevented.

Since a width of the engaging rims 52 can be widened with proper rigidity not to be excessive rigidity, it is possible to prevent twisting of the frame holder 5 by the engaging rims 52, and thus, to prevent the wobble of the outer blades 3 due to twisting of the frame holder 5. Furthermore, the engaging arms 52 reinforce the end walls 5*a*, to which the engaging grooves 50*a* and 50*b* engaged with fitting pieces 41 of the outer blade frames 4 are formed, in the longitudinal direction X, so that rigidity of the end walls 5*a* are increased in comparison with the case that mo engaging arms are formed, and thus, wobbling of the outer blades 3 can be prevented. Still furthermore, the frame holder 5 is positioned on the outer blade mounting base 6 and the frame holder 5 is fixed on the driving unit 12 of the head portion 10 by the engaging arms 52, so that it is possible to downsize the entire of the electric shaver 1.

Figure 11:
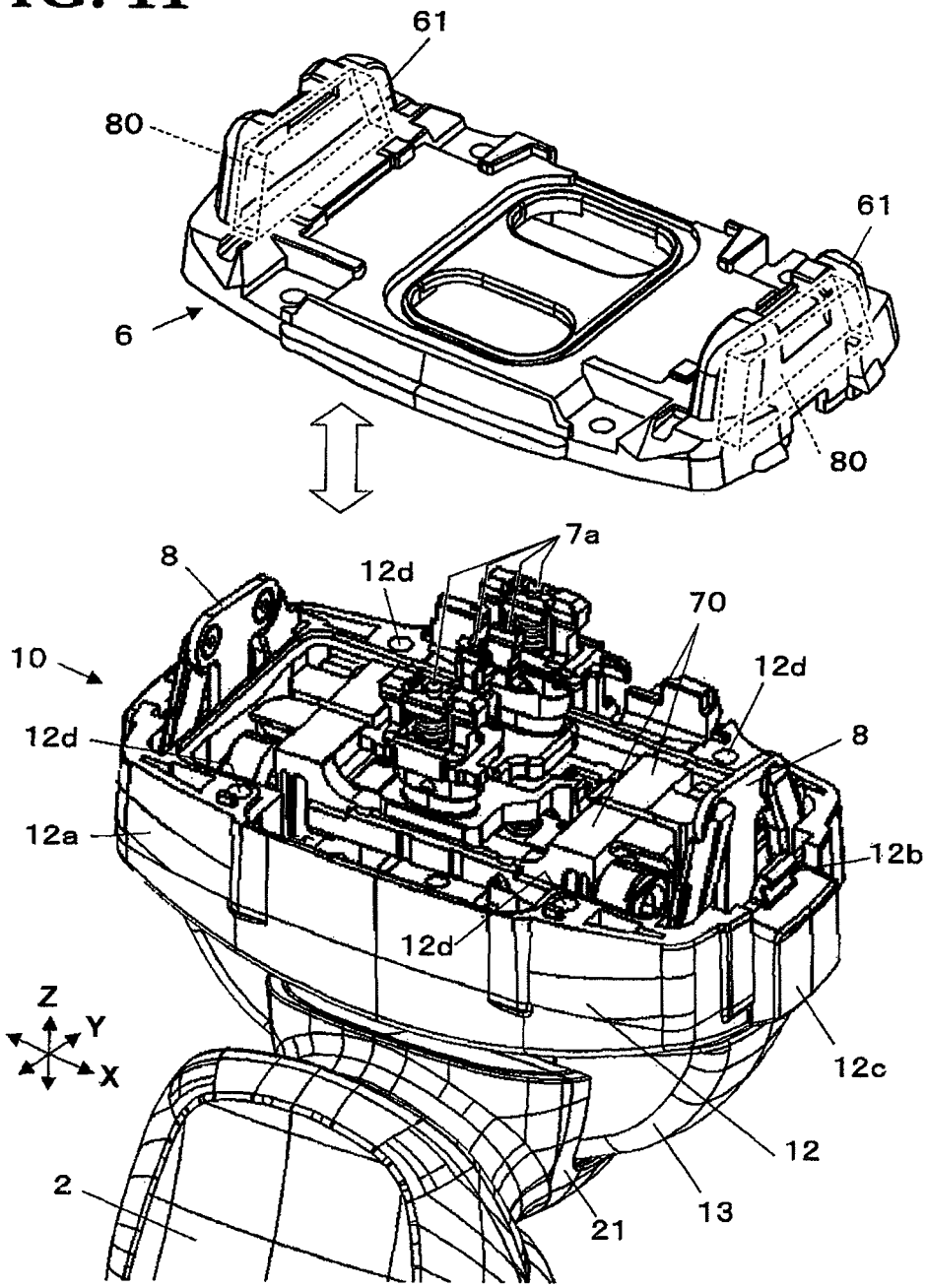
FIG. 11 is a perspective view showing a deformed configuration in a vicinity of the head portion of the electric shaver from which the inner blades and the outer blade mounting base are further removed.
Figure 12:
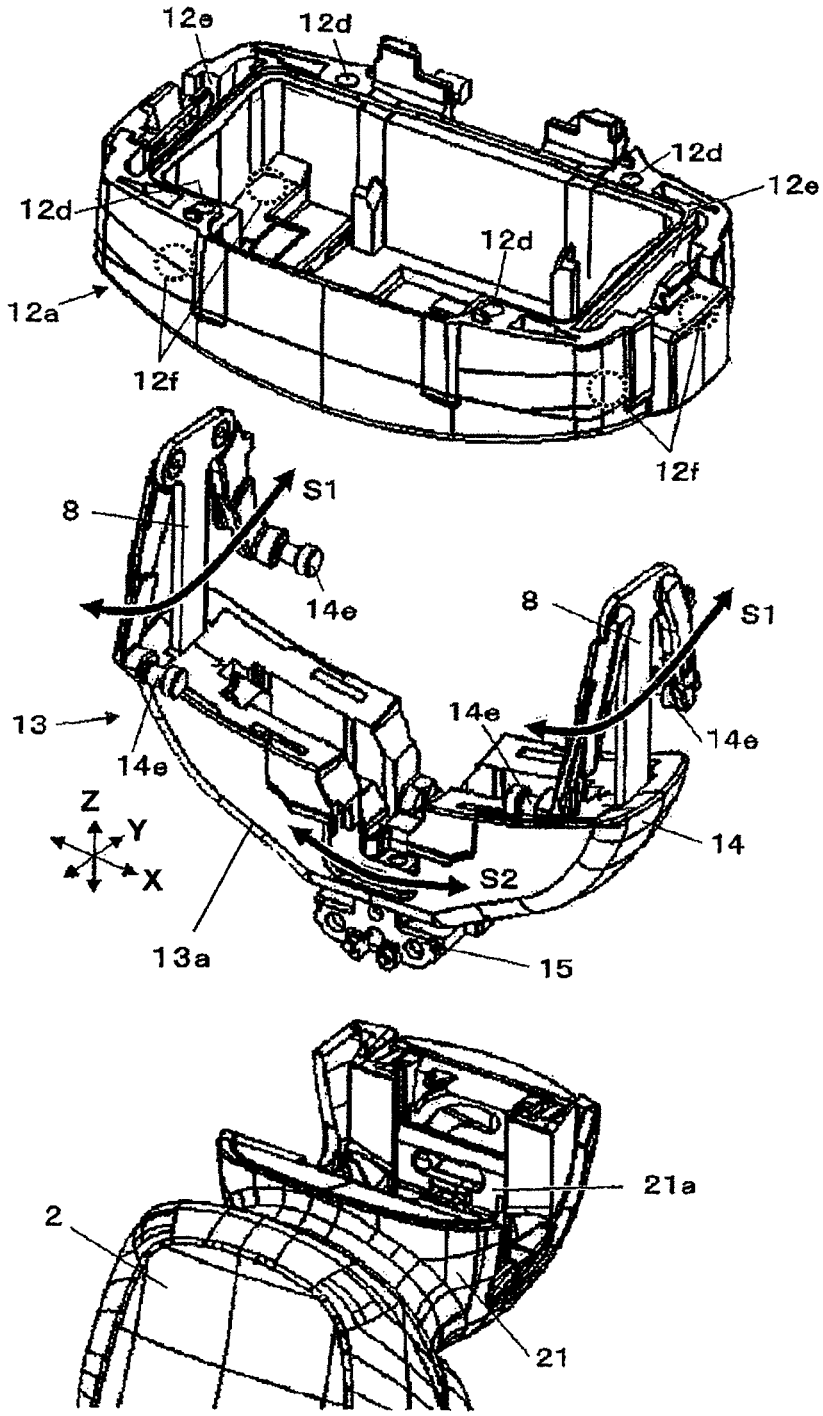
FIG. 12 is an exploded perspective view showing a configuration of the head portion of the electric shaver.
Figure 13:
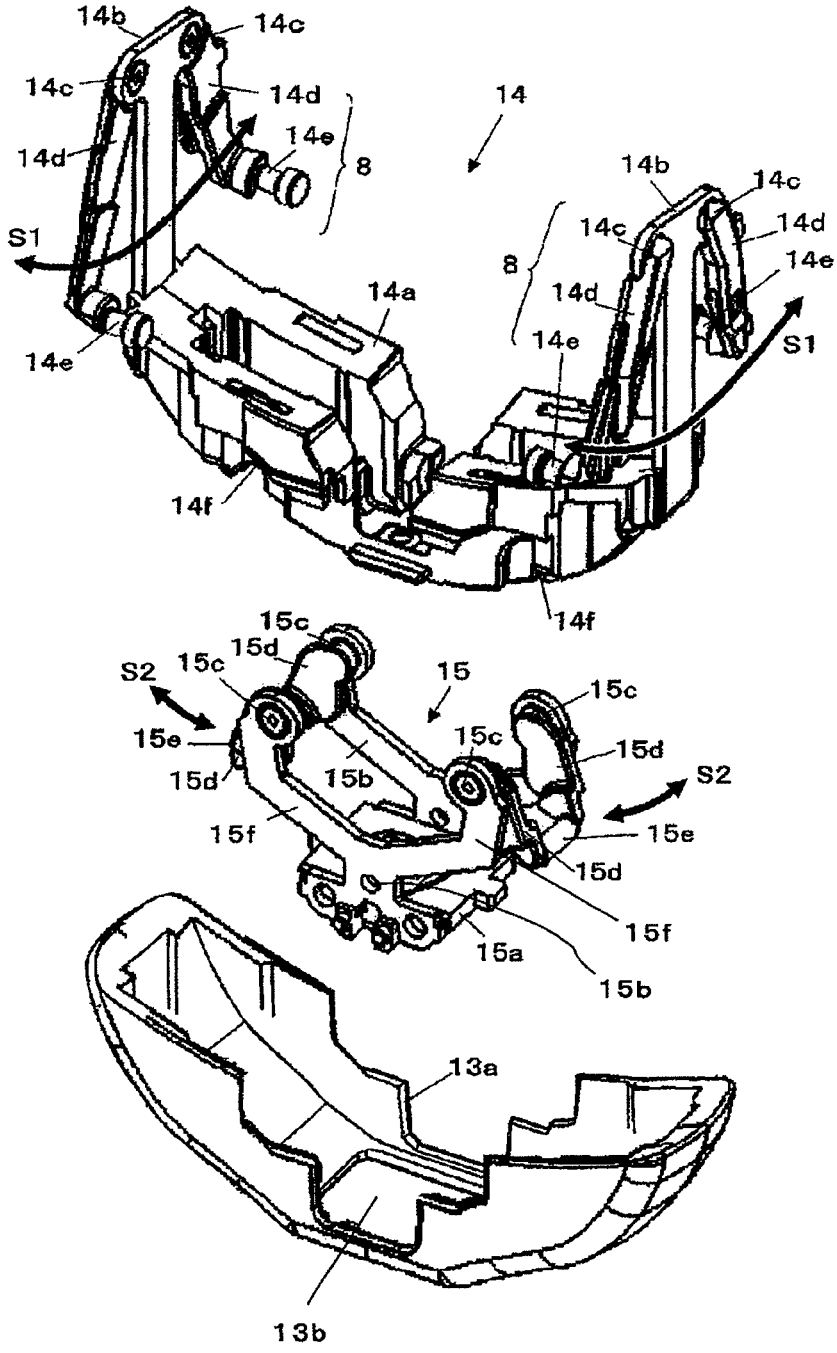
FIG. 13 is an exploded perspective view showing a configuration of a swing mechanism of the head portion of the electric shaver.

FIGS. 11, 12 and 13 respectively show a specific configuration of the swing mechanism 13 which enables to swing the heard portion 10 in both of the longitudinal direction X and the anteroposterior direction Y with respect to the main body 2. In FIGS. 1 to 10, the specific configuration of the swing mechanism 13 is omitted to simplify the illustration. As shown in FIG. 12, the swing mechanism 13 is configured of an anteroposterior swing unit 14 for enabling to swing the head portion 10 in the anteroposterior direction Y and a longitudinal swing unit 15 for enabling to swing the head portion 10 in the longitudinal direction X with respect to the main body 2.

The anteroposterior swing unit 14 is configured of a boat-shaped anteroposterior swing base 14*a* and a pair of link mechanisms 8 fixed on both ends of the anteroposterior swing base 14*a* in the longitudinal direction X. Each link mechanism 8 comprises a Tee-shaped first post 14*b* standing upward in the floating direction Z, a pair of first supporting points 14*c* provided at both ends of a top of the first post 14*b* in the anteroposterior direction Y, a pair of first bracketings 14*d* rotatably pivoted on the first supporting points 14*c*, and two of cylindrical first supporting members 14*e* each having a center axis parallel to the longitudinal direction X and projection inward in the longitudinal direction X. The first supporting member 14*e* can swing around the first supporting point 14*c* in the anteroposterior direction Y. Second supporting portions 12*f*, which are to be engaged with the first supporting members 14*e*, are formed on a bottom ends of the housing 12*a* of the driving unit 12 in the floating direction Z. When supporting the second supporting portions 12*f* of the housing 12*a* from below by the first supporting members 14*e*, the driving unit 12 of the head portion 10 can swing in the anteroposterior direction Y as shown by arrow S1. In addition, four of second supporting points 14*f*, by which the anteroposterior swing base 14*a* is supported by the longitudinal swing unit 15, are provided at a bottom of the anteroposterior swing base 14*a*.

As illustrated by dotted line in FIG. 11, cavities 80 are formed inside the protrusions 61 of the outer blade mounting base 6. Top portions of the link mechanisms 8 which constitute the swing mechanism 13 are contained in the inside of the cavities 80. As shown in FIG. 12, slits 12*e*, through which the link mechanisms 8 are inserted from below in the floating direction Z, are further formed on the housing 12*a* of the driving unit 12. When the housing 12*a* of the driving unit 12 is put on the anteroposterior swing base 14*a*, the link mechanisms 8 are inserted into the slits 12*e*, and the first supporting members 14*e* support the second supporting portions 12*f* of the housing 12*a* from below. Thereby, the head portion 10 including the driving unit 12 can swing in the anteroposterior direction Y shown by arrow S1.

The longitudinal swing unit 15 comprises a longitudinal swing base 15*a* which is fixed on a recess 21*a* formed on a head mounting unit 21 of the main body 2, a pair of second posts 15*b* arranged in parallel in the anteroposterior direction and each having a pair of arms 15*f* which extends in both sides of the longitudinal direction X from the longitudinal swing base 15*a*, four of third supporting points 15*c* respectively provided upper ends of the arms 15*f* of the second posts 15*b* in the floating direction Z, four of second bracketings 15*d* rotatably pivoted on the third supporting points 15*c* each, and a pair of rollers 15*e* which couples lower ends of a pair of second bracketings 15*d* arranged in the anteroposterior direction Y in both sides in the longitudinal direction X. The rollers 15*e* have center axes parallel to the anteroposterior direction Y, respectively. When the second supporting points 14*f* of the anteroposterior swing base 14*a* is mounted on a pair of the rollers 15*e*, the anteroposterior swing base 14*a* can swing in the longitudinal direction X shown by arrow S2 with respect to on the head mounting unit 21 of the main body 2. Consequently, the head portion 10 including the driving unit 12 and the swing mechanism 13 can swing in the longitudinal direction X and in the anteroposterior direction Y with respect to the main body 2.

Figure 14:
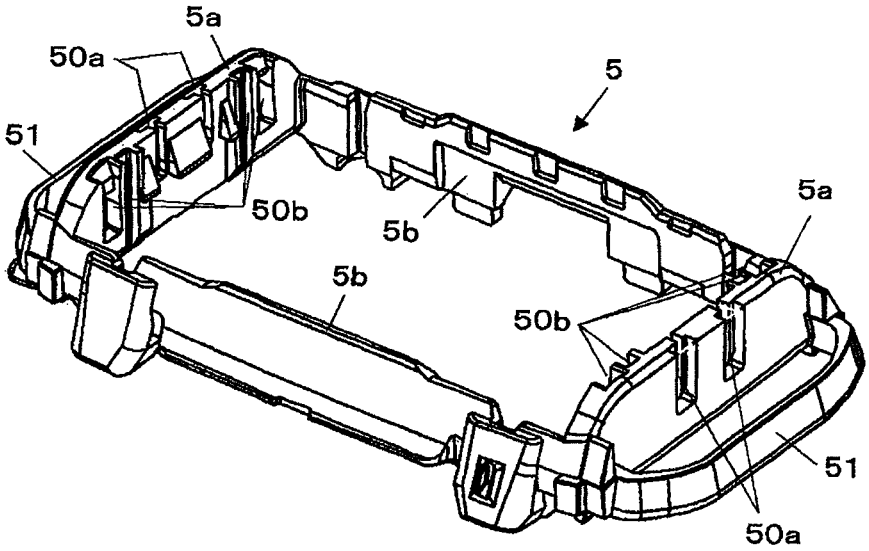
FIG. 14 is a perspective view showing a deformed configuration of the outer blade holder.
Figure 15:
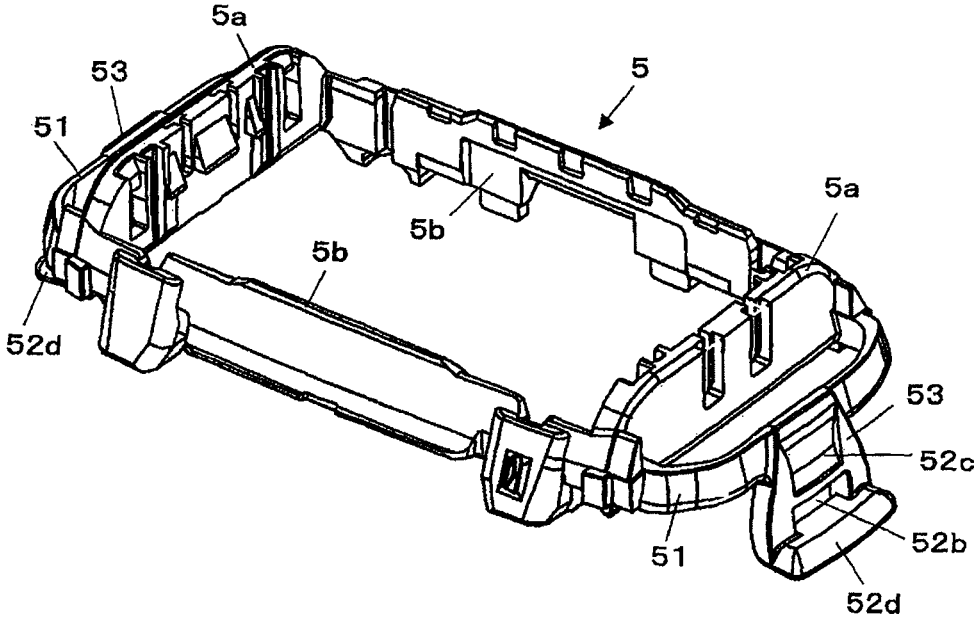
FIG. 15 is a perspective view showing another deformed configuration of the outer blade holder.

FIGS. 14 and 15 respectively show modifications of the frame holder 5. The frame holder 5 shown in FIG. 14 has no engaging arm 52 and comprises only the engaging rims 51. In addition, the frame holder 5 shown in FIG. 15 has only leg portions 53 of the engaging arms 52 further to the engaging rims 51. When such frame holder 5 is attached to the outer blade mounting base 6, the engaging rims 51 enclose the protrusions 61 of the outer blade mounting base 6, so that positioning of the frame holder 5 to the outer blade mounting base 6 can be performed precisely. In addition, since the end walls 5*a* of the frame holder 5 and the protrusions 61 of the outer blade mounting base 6 adjoin each other in the state that the frame holder 5 is mounted on the outer blade mounting base 6, the protrusions 61 serves as reinforcing members of the end walls 5*a* in the longitudinal direction X. Therefore, even when a large external force acts on the outer blades 3, quantities of warps of the end walls 5*a* of the frame holder 5 supporting the outer blade frames 4 become smaller, and thus, wobbling of the outer blades in use can be made smaller.

The present invention is not limited to the configuration of the above mentioned embodiment, and it is possible to modify in various manners. Although the electric shaver comprising four sets of inner blades and outer blades are exemplified in the above embodiment, it is possible to apply this invention to an electric shaver comprising three sets or two sets of inner blades and outer blades. In addition, the head portion 10 is not necessarily swingable in both of the longitudinal direction X and the anteroposterior direction Y, and it may be swingable in any one direction. Alternatively, the head portion may be fixed on the main body not swingable.

This application is based on Japanese patent application 2009007422 filed Jan. 16, 2009 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An electric shaver comprising:

a plurality of outer blades which comprise a metal thin plate, have an elongated shape in a first direction and are arranged in a second direction perpendicular to the first direction;

a plurality of outer blade frames having an elongated shape in the first direction and to which the outer blades are respectively attached;

a plurality of inner blades which are reciprocally and linearly moved in the first direction to slide on inner faces of the outer blades, and are arranged in the second direction;

a driver that has a plurality of inner blade attaching bases protruding outward in a third direction perpendicular to both of the first direction and the second direction and that drives the inner blades reciprocally and linearly in the first direction;

an outer blade mounting base which is provided on a top portion of the driver and includes a pair of protrusions provided at positions near both ends of the outer blade mounting base in the first direction, said protrusions protrude upward in the third direction and are elongated in the second direction; and a frame holder which is attached to the outer blade mounting base and has a pair of end walls arranged in parallel with the second direction and disposed inside of the protrusions of the outer blade mounting base in the first direction and a pair of engaging rims provided at both ends in the first direction that enclose and engage with the protrusions, when the frame holder is attached to the outer blade mounting base, wherein each of the end walls has a plurality of guide grooves elongated in the third direction to which the outer blade frames are engaged and hold the outer blade frames movable in the third direction.

2. The electric shaver in accordance with claim 1, wherein each of the end walls has a height, in the third direction, substantially equal to a height of the protrusions, in the third direction and the frame holder has a pair of engaging arms configured to protrude outward in the first direction and inward in the third direction from center portions of top faces of the end walls in the third direction so as to enclose the protrusions when the frame holder is attached to the outer blade mounting base.

3. The electric shaver in accordance with claim 2, wherein each engaging arm crosses the engaging rim at a middle portion thereof and is integrally formed with the engaging rim.

4. The electric shaver in accordance with claim 2, wherein a rigidity of the engaging arm is larger than a rigidity of the engaging rim.

5. The electric shaver in accordance with claim 2, wherein a rigidity adjusting groove is provided on the engaging arm that adjusts the rigidity of the engaging arm.

6. The electric shaver in accordance with claim 5, wherein a rigidity of the engaging arm is larger than a rigidity of the engaging rim.

7. The electric shaver in accordance with claim 2, wherein the frame holder has engaging portions integrally formed with the engaging arms or the engaging rims to be fixed to a housing of the driving unit.

8. The electric shaver in accordance with claim 1, wherein the electric shaver has a main body which is grippable by a user and a head portion which is swingable in at least one of the first direction and the second direction;

the head portion includes the driver and a swing mechanism which enables swinging of the head portion in at least one of the first direction and the second direction, a housing containing the driver and the swing mechanism and head cover attached to the housing;

the outer blade mounting base serves as a top cover of the housing;

each of the end walls has a height in the third direction, substantially equal to a height of the protrusions in the third direction;

the frame holder has a pair of engaging arms that protrude outward in the first direction and inward in the third direction from center portions of top faces of the end walls so as to enclose the protrusions when the frame holder is attached to the outer blade mounting base;

each the engaging arm crosses the engaging rim at a middle portion thereof and is integrally formed with the engaging rim; and an end of each engaging arm, that protrudes inward in the third direction, serves as an engaging portion engageable with both of the head cover and the outer blade mounting base so that the head cover is attached to the housing via the frame holder.

9. The electric shaver in accordance with claim 3, wherein rigidity of the engaging arm is larger than that of the engaging rim.

10. The electric shaver in accordance with claim 3, wherein a rigidity adjusting groove is formed on the engaging arm adjusts the rigidity of the engaging arm.

11. The electric shaver in accordance with claim 10, wherein a rigidity of the engaging arm is larger than a rigidity of the engaging rim.

12. The electric shaver in accordance with claim 3, wherein, the frame holder has engaging portions integrally formed with the engaging arms or the engaging rims to be fixed to a housing of the driving unit.

13. The electric shaver in accordance with claim 1, wherein a pair of the engaging rims are provided so as to protrude outward to bind an end of the rear side wall to an end of the front side wall at both ends of the frame holder in the first direction.

14. The electric shaver in accordance with claim 1, wherein an aperture is defined by each end wall of the frame holder and each engaging rim of the frame holder, the protrusions of the outer blade mounting base being engaged within the apertures.

15. The electric shaver according to claim 1, wherein the frame holder is attached to the outer blade mounting base such that the frame holder is positioned over the outer blade mounting base, the protrusions of the outer blade mounting base projecting upwardly, in the third direction, to be engaged by the engaging rims of the frame holder.

* * * * *